US006098436A

United States Patent [19]

Girardello et al.

[11] Patent Number: 6,098,436

[45] Date of Patent: Aug. 8, 2000

[54] METALWORKING METHOD AND PRODUCT OBTAINED WITH THE METHOD

[76] Inventors: Pierangelo Girardello, Via Monfenera, 40, 31033 Castelfranco Veneto; Bruno Girardello, Quartiere Longhin, 26, 31039 Riese Pio X; Giampaolo Girardello, Via Monfenera, 7, 31033 Castelfranco Veneto, all of Italy

[21] Appl. No.: 09/151,796

[22] Filed: Sep. 22, 1998

[30] Foreign Application Priority Data

Oct. 21, 1997 [IT] Italy ..... TV97A0144

[51] Int. Cl.[7] ..... G01D 18/00

[52] U.S. Cl. ..... 72/42; 72/348; 72/254; 72/267

[58] Field of Search ..... 72/40, 39, 41, 72/42, 254, 264, 267, 347, 348, 349, 335, 333, 339, 330

[56] References Cited

U.S. PATENT DOCUMENTS

| | | | |
|---|---|---|---|
| 1,722,634 | 7/1929 | Kinkead | 72/267 |
| 3,184,945 | 5/1965 | Hornak et al. | 72/267 |
| 3,507,140 | 4/1970 | Tassaro | 72/267 |
| 3,566,741 | 3/1971 | Sliney | 72/258 |
| 3,893,326 | 7/1975 | Oberlander et al. | 72/347 |
| 4,416,705 | 11/1983 | Siemund et al. | 148/6.15 Z |
| 5,634,979 | 6/1997 | Carlson et al. | 134/3 |

FOREIGN PATENT DOCUMENTS

| | | | |
|---|---|---|---|
| 847 88 | 1/1896 | Germany . | |
| 133 028 | 8/1902 | Germany . | |
| 69 33 974 | 1/1971 | Germany . | |
| 197 25 220 | 12/1997 | Germany . | |
| 576 941 | 5/1958 | Italy | 72/267 |
| 561 327 | 5/1960 | Italy | 72/267 |
| 90 14900 | 12/1990 | WIPO . | |

OTHER PUBLICATIONS

Patent Abstracts of Japan vol. 4, No. 176 (M–045), Dec. 5, 1980 & JP 55 126 341 A (Sumitomo Metal Ind Ltd), Sep. 30, 1980 * abstract *.

*Primary Examiner*—Rodney Butler
*Attorney, Agent, or Firm*—Guido Modiano; Albert Josif

[57] ABSTRACT

A metalworking method, particularly for obtaining lengths of tube of various sizes and for various uses, made of steel having a carbon content between 0.10% and 0.50% with narrow tolerances. The method entails the provision, as initial material, of a round bar of hot-rolled steel, which is then peeled and cut so as to obtain at least one block, which is drilled and subjected to a chemical treatment. The block is then pressed and optionally subjected to final turning and heat treatment so as to obtain a finished product, such as a hydraulic or oleodynamic cylinder or a casing for high-pressure filters or a tube for high pressures, or a bushing, by using a reduced amount of steel.

8 Claims, 4 Drawing Sheets

METALWORKING METHOD AND PRODUCT OBTAINED WITH THE METHOD

BACKGROUND OF THE INVENTION

The present invention relates to a metalworking method and to the corresponding product obtained with the method, particularly lengths of tube for various uses made of steel having a carbon content of 0.10% to 0.50%, i.e., steel of the type ranging from AISI/SAE 1010 to AISI/SAE 4150 (special casehardening steels and hardening and tempering steels from C10 to 50CrMo4), as listed for example in the tables of "The Stahlschlüssel Reference Book (Key To Steel)", 1989.

Currently, the most widely used methods for obtaining lengths of tube made of steel of the above-cited type are forging, hot extrusion (also known as drawing), forward cold extrusion, hot rolling (seamless, method known as Mannesmann method), and drilling from a length of rolled solid bar.

As regards the forging process, it entails the following steps (see FIGS. 1, 2 and 3): one begins with a length 1 of round bar or billet of suitable size (for example a billet with a side A having a square cross-section of 40 to 140 mm), cut to a length which depends on the volume of the part to be obtained (see FIG. 2).

The billet length 1 is heated to a temperature of approximately 1200° C. in a furnace, usually of the gas-fired type.

Punching is then performed: the still-hot length of billet 1 is placed on top of a die 2 arranged inside a press and upsetting with a punch 3 is performed until a typical cup-like shaped part 4 (see FIGS. 1 and 3), with an axial cavity having a diameter a, is formed.

The shaped part 4 is then extracted and is placed, while it is still hot, inside a cylindrical die 5 and then deformed by means of a punch.

The metallic material is compressed with a given force F by the punch 3 and assumes the profile of the punch and of the die, obtaining a rough-shaped tube 6 of suitable thickness.

The tip 7 of the tube (also known as bottom) that remains to be shaped is then trimmed or cut (see FIG. 4).

The last step of the process is the cutting of the tube 6 to obtain lengths of the intended size.

Forging is usually performed in a plurality of passes until the intended shape of the tube is obtained.

This known process therefore allows to obtain a rough-shaped tube whose length, besides depending on the thickness, can exceed one meter only with great difficulty; moreover, the external and internal finish has scale, scores and other imperfections; concentricity tolerances which can reach 10 to 30% of the thickness of the tube are also obtained.

The described process also entails other drawbacks, since very large and expensive machines are required.

Moreover, since tool changing processes are time-consuming, this known process requires minimum quantities of product in excess of 100 tons in order to be financially convenient.

Finally, this process is not suitable for producing low-thickness tubes.

The product obtained with the method further requires additional working in order to obtain a length of tube suitable for the above-described uses, such as internal and external turning in order to restore the necessary tolerances and eliminate the layer of material whose metallurgical characteristics have been altered by heating.

Finally, it is necessary to cut the bars in order to obtain a length of tube having the intended longitudinal dimension; approximately 2 to 5% of the material is wasted in the trimming step for this treatment.

The hot extrusion process instead entails the following steps. Up to the punching step, the process is identical to the forging process. The part is then extracted while still hot, and external and internal drawing is performed; during the drawing, the metallic material, pulled by a force F through a tool known as drawplate, assumes the profile of the drawplate, with a deformed cross-section which is smaller than the cross-section it had at the inlet, and the thickness of the tube is also reduced by means of a mandrel or punch 8 inserted internally (see FIG. 5).

The bottom is then trimmed or cut as in the previous method.

The last step of the process consists in cutting the tube to obtain lengths having the chosen longitudinal dimension.

Drawing is usually performed in a plurality of passes which depend on the thickness of the tube to be obtained.

This known process can be used on a smaller range of steels and the resulting product is constituted by a rough-shaped tube whose length, besides depending on the thickness, can exceed 2 meters with great difficulty, with an internal and external surface finish having scale, scores and other imperfections, and with concentricity tolerances which can reach 10 to 30% of the thickness.

The process differs from hot forging in that it is more suitable for tubes of considerable length and for low thicknesses.

Moreover, the described process entails other drawbacks, since it is necessary to use very large and expensive machines.

Tool changing processes are still time-consuming and accordingly the process still requires minimum product quantities in excess of 100 tons in order to be financially convenient.

The resulting product requires further working in order to obtain a length of tube which is suitable for the above-described uses, such as internal and external turning in order to restore the necessary tolerances and eliminate the layer of material whose metallurgical characteristics have been altered by heating, and finally requires the cutting of the bars in order to obtain the length of tube having the intended longitudinal dimensions.

Approximately 2 to 5% of the material is wasted in the trimming step for this known type of metalworking.

We now consider the known forward cold extrusion process: it entails the following steps (shown sequentially in FIG. 6):

- the cutting of a length 10 from a round bar of rolled steel (the length has a longitudinal dimension which depends on the dimensions of the part to be obtained);
- sanding in order to eliminate steel rolling scale and to prepare the surface of the part;
- chemical surface treatment of the material by means of cleaning—phosphatizing—neutralizing—stearate treatment (or soap treatment) steps;
- punching of the material: the block is pressed in a press (with a rating of at least 200 tons) to obtain a first cup-shaped part 11.

The part is again subjected to a chemical surface treatment similar to the previous one.

The part is then extruded (the material, arranged inside a die, due to the pressure applied by the punch, causes the extruded element to flow in the opposite direction with respect to the advancement of the punch) and is thus elongated to the required size (reference numeral 12).

A new step of chemical surface treatment is then performed.

Finally, the end (or bottom) 13 is trimmed mechanically.

This process can be used only with steels of the type having a carbon content up to 0.20% (AISI/SAE 1020 steels) and with rolled round bars having a diameter of less than 60 mm.

The finished product is constituted by a tube 14 having a good internal and external finish, with size tolerances within 0.20 mm and with concentricity values variable from 0.4 to 0.5 mm.

However, in order to obtain tubes having external dimensions of more than 60 mm (again for steels with a carbon content up to 0.20%), it would be necessary to provide additional extrusion steps, and preliminary annealing, sanding and chemical surface treatment operations would be required before each extrusion step and also before the trimming of the end.

Extrusion for materials with a carbon content above 0.20% is possible but requires a normalization (or spheroidizing) step to optimize the formability of the steel after each one of the cutting, punching and extrusion steps and after each additional extrusion step. Accordingly, the advantages that can be achieved with the process are obtained only in large-volume production (above 50 to 100 tons of product) and with plants of considerable size and power.

This process, too, requires large and expensive machines with very long tooling times which accordingly require very large production batches (50 to 100 tons of product).

Costs increase due to the large number of formability optimizing treatments for steels having a carbon content in excess of 0.20% or with a diameter of more than 60 mm.

There are additional very high costs for the manual treatment of the material during the phosphating and stearate treatment step; the cup-like shape in fact entails the risk that the part might contain the liquid when it leaves the chemical treatment and the part must therefore be emptied.

Approximately 10% of the material is lost during trimming for this kind of metalworking.

We now consider the hot-rolling (seamless) process.

The hot-rolling process is universally known and designated as the Mannesmann process; its description is omitted because it is known (an exemplifying diagram is provided in FIG. 7).

This process can be used on a great variety of materials: the product that is obtained is a rough-shaped tube with a length of even 6 to 8 meters, with an external and internal surface finish which is better than in the previously described hot processes, but nonetheless with a production of scale, scores and other imperfections and with concentricity tolerances which can reach 0.7 to 1.0 mm.

The process differs from other hot processes in that it is more suitable for tubes of considerable length and with low thicknesses.

The described process also entails other drawbacks: the processes for changing the tools are time-consuming and therefore the process again requires minimum product quantities in excess of 100 tons to be financially convenient.

Very large and expensive machines are again required and the resulting product requires further working in order to obtain a length of tube which is suitable for the above-described uses, such as internal and external turning in order to restore the necessary tolerances and eliminate the layer of material whose metallurgical characteristics have been altered by heating, and finally requires the cutting of the bars in order to obtain the length of tube having the intended longitudinal dimensions.

Finally, we consider drilling from a length of rolled solid bar.

This method entails the following mechanical treatments: the cutting of an initial block from rolled round steel bars; and mechanical chip-forming machining of the block at its inside and outside diameters and along its length.

This known process can be used in various materials and allows to obtain a product constituted by a tube having a good internal and external finish which meets the required tolerances; however, there are drawbacks, such as long treatment times, high tool wear, especially with materials having a carbon content of less than 0.20%; moreover, for these materials, owing to their limited chip-forming ability, the possibility to machine the bore with points of the hard-metal type is limited, consequently increasing the machining times and the costs; a high consumption of necessary material is also observed since more than 50% of the material is lost as machining waste.

SUMMARY OF THE INVENTION

The aim of the present invention is to solve the technical problems pointed out in the prior art, eliminating the above-mentioned drawbacks of known types, by providing a metalworking method, particularly for obtaining lengths of tube of various sizes and for various uses, made of steel having a carbon content between 0.10 and 0.50% with narrow tolerances, requiring machines which are more compact, have a lower power rating and short tooling times.

Within the scope of this aim, an important object of the present invention is to provide a method which is also suitable to produce small batches (for example also 1 ton of product) while still achieving competitive costs.

Another important object of the present invention is to provide a method in which it is possible to use materials having diameters of more than 60 mm or with a higher carbon content than the AISI/SAE 1020 type, with a containment of the number of steps required and of the costs to obtain the intended products.

Another important object of the present invention is to provide a method in which it is possible to avoid, for example if a bushing is to be obtained, the turning of the body thereof.

Another important object of the present invention is to provide a method in which, for example with respect to the known hot process, there is a smaller amount of material to be eliminated with a turning operation to be performed for example to obtain bushings.

Another important object of the present invention is to provide a method in which, for example with respect to the known process which entails drilling from a length of rolled solid bar, there is still a smaller amount of material to be eliminated with the turning operation to be performed, for example, to obtain bushings, further using a much smaller amount of steel.

This aim, these objects and others which will become apparent hereinafter are achieved by a metalworking method, particularly for obtaining lengths of tube of various sizes and for various uses, made of steel having a carbon content between 0.10% and 0.50% with narrow tolerances, comprising the following steps:

producing a round bar of hot-rolled steel;

peeling said bar;

cutting said bar so as to obtain at least one block;

drilling said block;

chemically treating said drilled block;

pressing said block.

In addition an optional final turning and heat treatment can be applied so as to obtain a finished product, such as a hydraulic or oleodynamic cylinder or a casing for high-pressure filters or a tube for high pressures or a bushing. The finished product is obtained by using a reduced amount of steel.

BRIEF DESCRIPTION OF THE DRAWINGS

Further characteristics and advantages of the present invention will become apparent from the following detailed description of some particular but not exclusive embodiments thereof, illustrated only by way of non-limitative example in the accompanying drawings, wherein.

DESCRIPTION OF THE PREFERRED EMBODIMENTS

Figure 1:
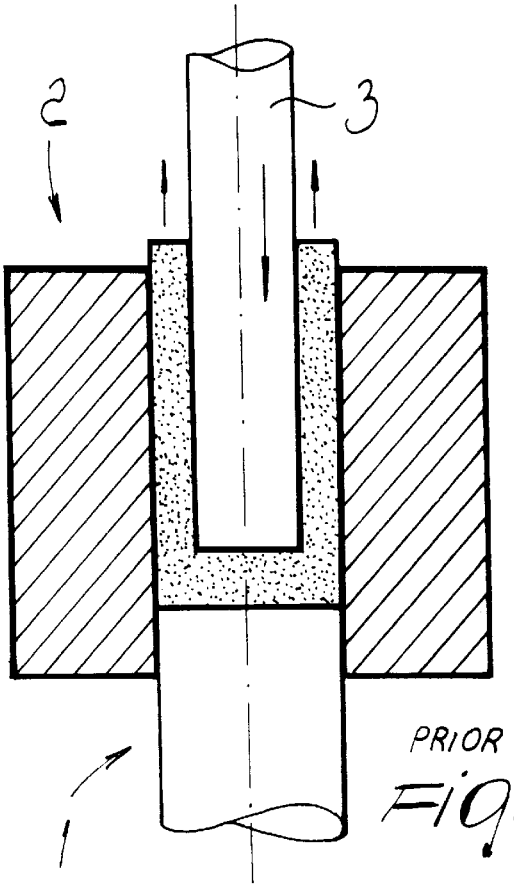
PRIOR ART Fig. 1
FIGS. 1 to 7 are partially sectional views of examples of the prior art methods.
Figure 2:
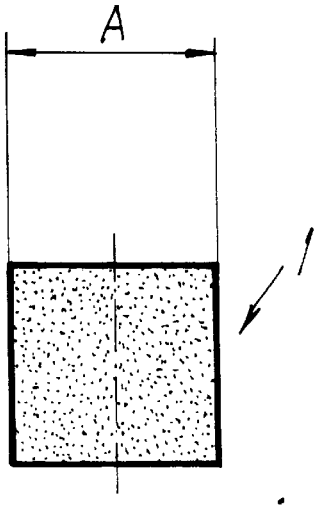
Fig. 2 PRIOR ART
Figure 3:
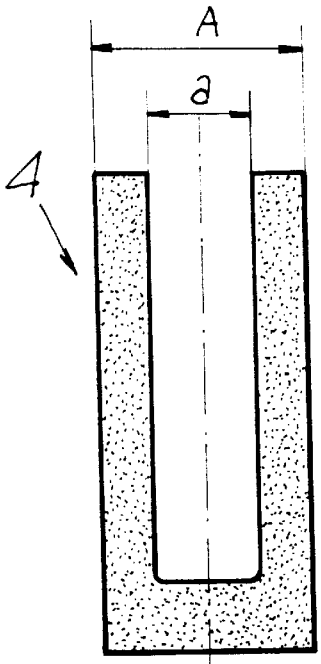
Fig. 3 PRIOR ART
Figure 4:
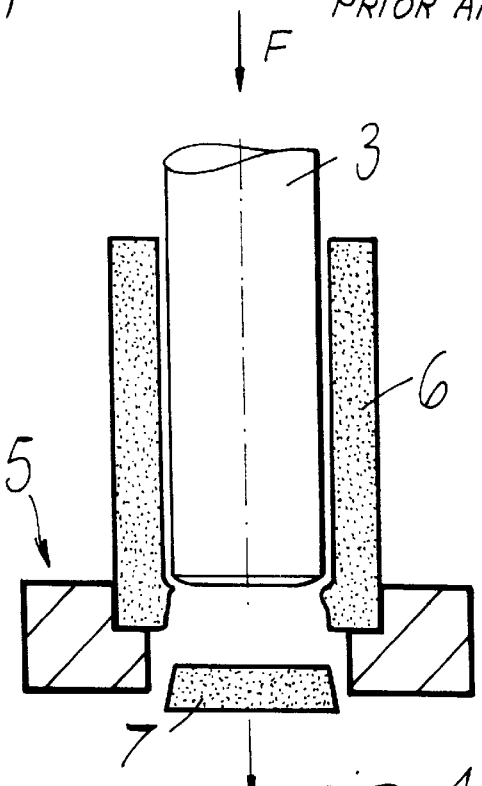
Fig. 4 PRIOR ART
Figure 5:
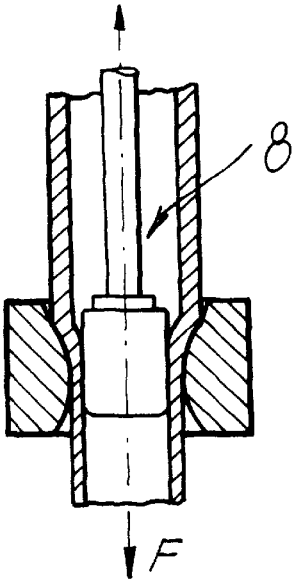
Fig. 5 PRIOR ART
Figure 7:
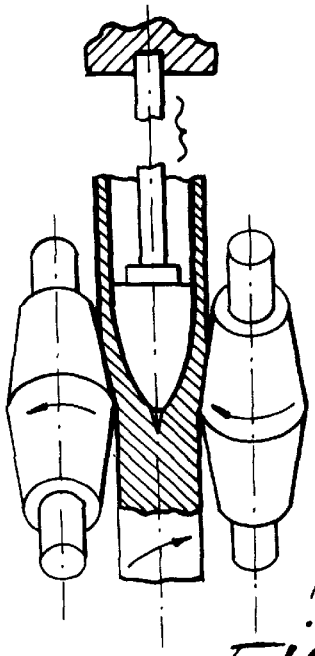
PRIOR ART Fig. 7
Figure 6:
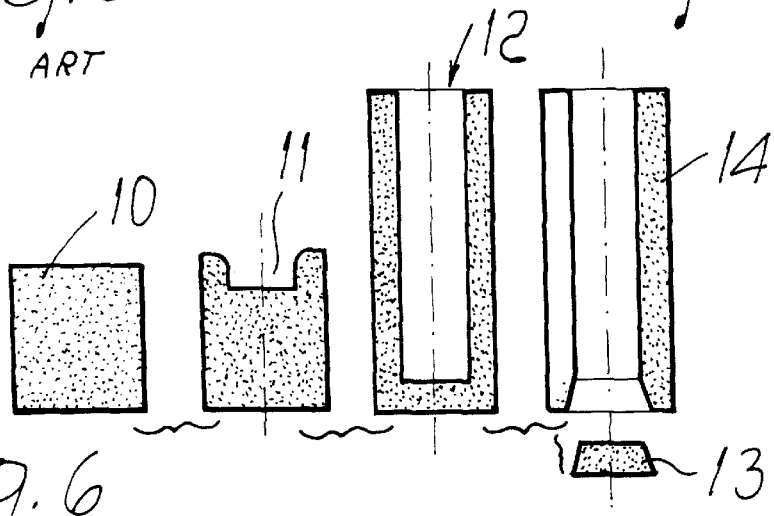
Fig. 6 PRIOR ART

The metalworking method according to the present invention provides for an initial step in which a drilled block 15 is prepared (see FIG. 8); the raw material of the method is constituted by round bars of hot-rolled steel.

The first operation is the peeling of the bar in order to remove the layer of material whose metallurgical characteristics are altered, which is usually present on the outside of the round bar.

The peeled bar is then cut into blocks 15 whose length depends on the chosen final longitudinal dimension of the length of tube; this is followed by a through drilling of the block with a bore whose diameter can vary from 10 to 50 mm.

During this step, only approximately 10% of the material is lost as swarf.

The method then entails a chemical treatment of the drilled block 15, which is therefore subjected to a chemical surface treatment which provides for its sequential immersion in the following solutions:

an alkaline degreasing solution based on sodium hydroxide and metallic sodium silicates, in a percentage between 2 and 15% in water, at a temperature of 70 to 95° C., for a time which can vary between 5 and 15 minutes;

rinsing in hot water at a temperature of 60 to 85° C. or a time which can vary between 5 and 15 minutes;

a phosphatizing solution based on: zinc phosphate diacid, nitric acid, zinc nitrate and phosphoric acid, diluted in water at 5 to 20%, at a temperature of 60 to 85° C. for a time which can vary between 5 and 15 minutes, to produce a zinc phosphate coating which is compact and uniform and has a very fine crystalline structure in order to facilitate the mechanical deformation of the material when cold;

rinsing in hot water at a temperature of 60 to 85° C. for a time which can vary between 5 and 15 minutes;

a passivating neutralizing alkaline-reacting solution based on sodium borates, sodium carbonate and sodium sulphite diluted in water so as to obtain a pH between 7 and 9.5 for a time which can vary between 5 and 15 minutes;

a lubricating solution (for example soap) based on sodium stearates, which by reacting with the zinc phosphate coating, forms zinc soaps, which further improve the antifriction barrier of the coating and also provide excellent lubrication.

The percentage of dilution of the soap in water preferably varies between 3 and 12%, at a temperature of 60 to 80° C., for a time which can vary between 2 and 10 minutes.

The method then entails performing pressing (or backward drawing). The block 15, after chemical treatment, is in fact subjected to a pressing operation; accordingly, it is inserted in a die made of special steel for hot metalworking (such as AISI/SAE H13) and, through the compression applied by the passage of a plunger (a cone with an angle of aperture between 10 and 50°) in the bore, the material is deformed in the opposite direction with respect to the advancement of the plunger, reaching the intended dimensions (see reference numeral 15*a*).

Figure 8:
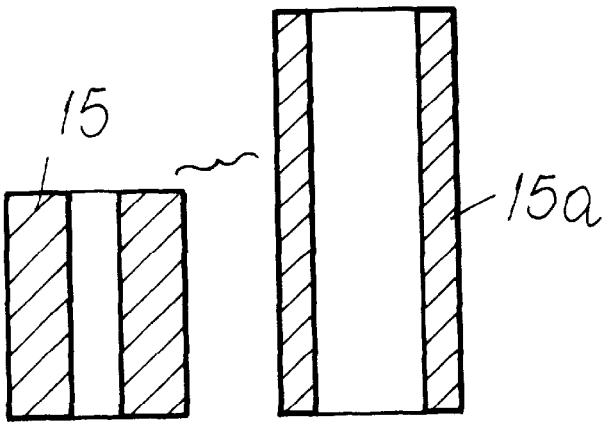
FIG. 8 is a sectional view of a length of tube obtained with the method according to the present invention.

FIG. 8 illustrates the blocks 15 and 15*a* before (15) and after (15*a*) the pressing step.

As mentioned, the above method applies to products made of steel of the types from AISI/SAE 1010 to AISI/SAE 4150 (special casehardening and hardening and tempering steels from C10 to 50CrMo4).

The product obtained, already after the pressing step, is finished internally and externally with the required tolerances without requiring any additional working to restore it to the required dimensions and with a very good degree of surface finish, accordingly complying with the following tolerances:

maximum roughness of the external and internal surfaces equal to Ra 3.5;

maximum value of concentricity between the inside and outside diameters equal to 0.20 mm;

size tolerance of the outside diameter within 0.20 mm;

size tolerance of the inside diameter within 0.12 mm.

The dimensions of the length of tube that can be obtained, depending on the uses for which it is produced, may be various: a length of up to 1 meter or more; an outside diameter which can vary from 40 mm to 150 mm; and obtainable thicknesses which can vary between 5 and 80 mm.

The length of tube segment that is produced can then be used to obtain, by means of additional working, finished products such as hydraulic and oleodynamic cylinders, casings for high-pressure filters, high-pressure tubes, and bushings.

With respect to hot forging, hot extrusion and hot rolling (Mannesmann process), the method according to the invention entails many advantages: the machines required are in fact simpler, smaller, less powerful and less expensive.

Tooling times are also shorter and accordingly the new method is also suitable for the production of small batches (also 1 ton of product).

The product obtained with the new method has a very good degree of finish of the outer and inner surface, and in most applications it can be used as a finished product, whereas the hot-formed product requires additional working both on its outer surface and on its inner surface to eliminate scale, scores and other imperfections.

The product obtained with the new method achieves, due to work-hardening, better mechanical characteristics than the material obtained with the hot process, in many cases avoiding the need for additional heat treatments.

In this regard, the following comparison table is given:

| Steel quality | Hot process RM N/mm2 | New process RM N/mm2 |
|---|---|---|
| AISI/SAE 1010 (C10) | 300–400 | 600–800 |
| AISI/SAE 1040 (C40) | 450–600 | 600–900 |

where RM designates the ultimate tensile strength of the material.

A higher value indicates higher mechanical strength.

The advantages obtainable with the new method with respect to forward cold extrusion are as follows: the machines required are smaller, less powerful and less expensive.

Moreover, tooling times are shorter and accordingly the new process is also suitable for the production of small batches (also 1 ton of product).

With the forward cold extrusion process it is not possible to use materials having a diameter of more than 60 mm or a carbon content higher than AISI/SAE 1020, unless additional treatment steps are added which increase the cost of the finished product.

The new method allows to obtain tubes having a better value of concentricity between the inside diameter and the outside diameter.

The advantages obtained with the new method with respect to drilling from a length of rolled solid bar are instead as follows: the treatment times are much shorter due to the difficulty of the drilling operation, especially for diameters in excess of 50 mm, and due to the need to perform the full turning of the outside diameter of the part.

With the new method, the amount of steel required to produce the same length of tube can be reduced to 50%.

The product obtained with the new method achieves, due to work-hardening, better mechanical characteristics than the product obtained from a raw bar, as shown by the accompanying exemplifying table:

| Steel quality | For rolled steel RM N/mm2 | For new method Rm N/mm2 |
|---|---|---|
| AISI/SAE 1010(C10) | 250–400 | 600–800 |
| AISI/SAE 1040(C40) | 400–600 | 600–900 |

where RM designates the ultimate tensile strength of the material.

A higher value indicates a higher mechanical strength.

It has been observed that the invention thus conceived has achieved the intended aim and objects.

By way of example, the use of the method to obtain bushings for tracks of tractors and excavators (and generally for all tracked vehicles) is described.

Figure 9:
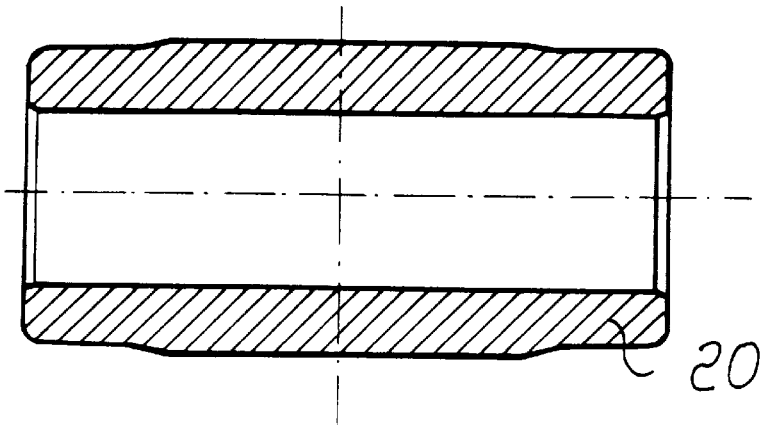
Fig. 9 PRIOR ART
FIGS. 9 to 12 are views, similar to the preceding ones, illustrating examples of the prior art methods.

An example of bushing 20 is shown in FIG. 9.

As mentioned, it is known to use, for the production of bushings 20, the known processes such as production by forward cold extrusion, production starting from a tube produced with hot-forming methods, and production with drilling from a length of a rolled solid bar.

Figure 10:
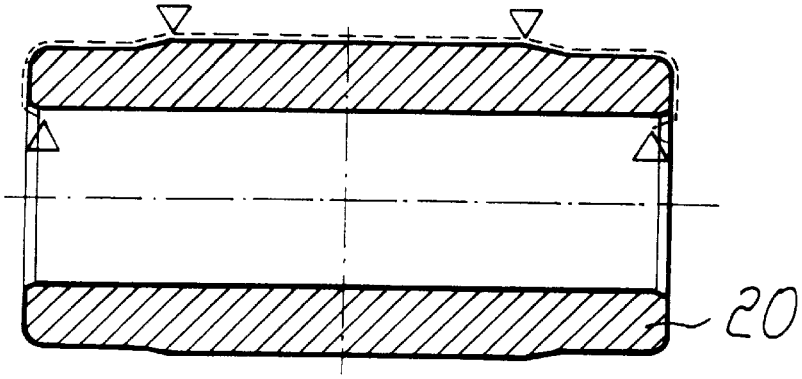
Fig. 10 PRIOR ART

If the method for production by forward extrusion is used, such method entails all of the steps described earlier for the production of the length of tube, followed by turning of the part to bring it to the intended shape (turning performed in the regions shown in FIG. 10).

Finally, the heat treatment required to obtain the intended mechanical characteristics (hardening or casehardening) is performed.

Figure 11:
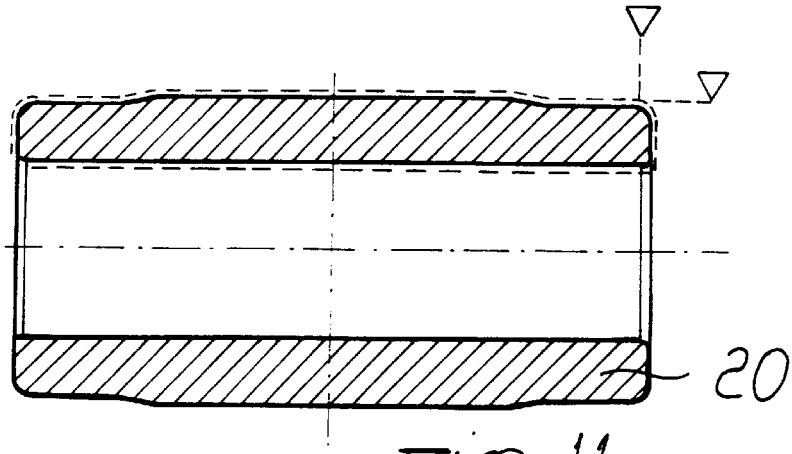
Fig. 11 PRIOR ART

If production by means of hot processes is used, such processes entail all the steps described earlier for the production of the length of tube, whereafter the tube is cut to obtain the intended longitudinal dimension. Finally, full turning of the part is performed (in the regions indicated in FIG. 11), accordingly affecting the entire surface of the part, in order to obtain the required shape tolerances and eliminate the scale due to hot-forming.

Finally, the heat treatment required to obtain the intended mechanical characteristics (hardening or casehardening) is performed.

Figure 12:
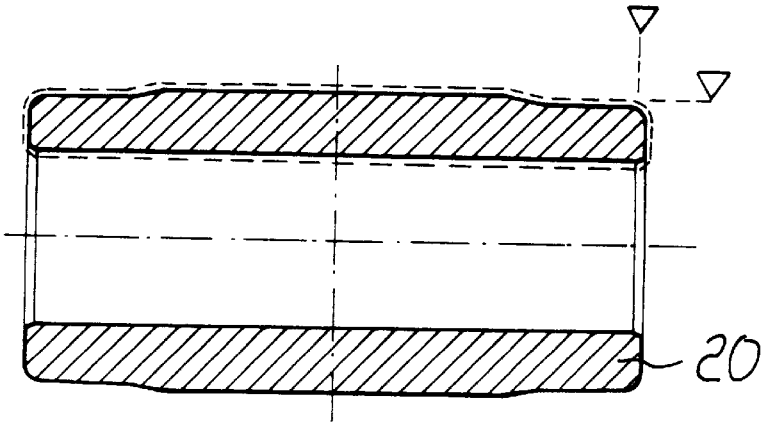
Fig. 12 PRIOR ART

If production by drilling from a block is used, the process entails all of the steps described earlier for the production of the tube segment, followed by turning to the intended shape (turning performed in the regions indicated in FIG. 12).

Finally, the heat treatment required to obtain the intended mechanical characteristics (hardening or casehardening) is performed.

Figure 13:
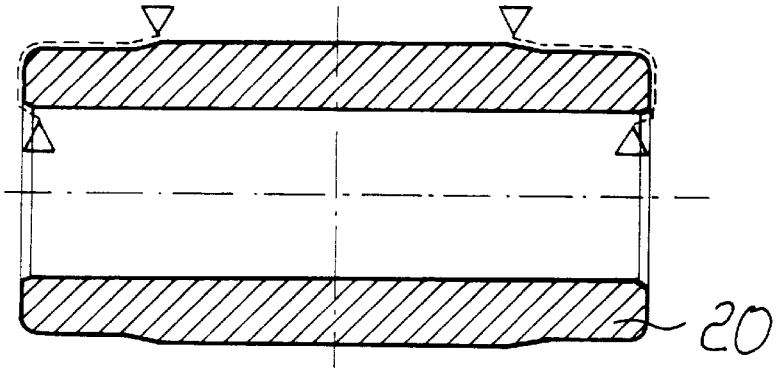
FIGS. 13 and 14 are views, similar to the preceding ones, illustrating an embodiment of the method according to the present invention.

According to the present method, instead, once the part has been obtained according to the described steps, the part is brought to the intended shape through a turning step (turning performed in the regions indicated in FIG. 13).

Finally, the heat treatment required to obtain the intended mechanical characteristics (hardening or casehardening) is performed.

The advantages of the new method with respect to production by forward cold extrusion are those that have already been described: therefore, the use of machines which are smaller, less powerful and less expensive, with shorter tooling times; accordingly, the new method is also suitable for small-batch production (also 1 ton of product).

In order to obtain the same product in the case of forward cold extrusion, in most cases it is necessary to perform a plurality of steps and the intermediate normalization treatment contributes toward a cost increase.

Moreover, with the forward cold extrusion process it is not possible to use materials having a diameter of more than 60 mm or having a carbon content higher than type AISI/SAE 1020 unless additional treatment steps are added which increase the cost of the finished product.

Figure 14:
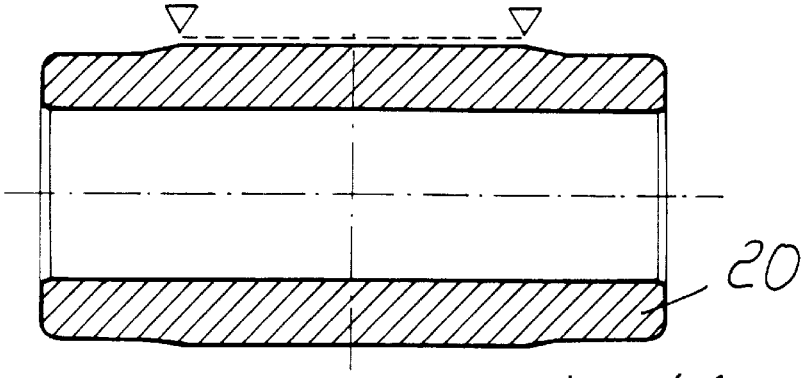

With the new method it is possible to avoid turning the body of the bushing (region indicated in FIG. 14).

The advantages of the new method with respect to production starting from a tube produced with hot-forming processes, in addition to the above-described ones, are a much smaller amount of material to be eliminated with the turning operation to be performed for bushings produced with the new process with respect to the amount of material to be eliminated with the full internal and external turning operation required with the method that starts from a tube.

The advantages of the new method with respect to production with drilling from a length of rolled solid bar, in addition to the ones already described above, are again a much smaller amount of material to be eliminated with the turning operation to be performed for bushings produced with the new method with respect to the amount of material to be eliminated with the full internal and external turning operation required with the method starting from a length of metal.

With the new method, the amount of steel required to produce the tube can be reduced by as much as 50%.

The invention is of course susceptible of numerous modifications and variations, all of which are within the scope of the same inventive concept.

For example the method steps of the present invention may also be carried out in a different order.

The materials and the dimensions that constitute the individual components of the product obtained with said method can of course also be the most pertinent according to specific requirements.

The disclosures in Italian Patent Application No. TV97A000144 from which this application claims priority are incorporated herein by reference.

What is claimed is:

1. A metalworking method, particularly for obtaining lengths of tube of various sizes and for various uses, made of steel having a carbon content between 0.10% and 0.50% with narrow tolerances, comprising the following steps:

producing a round bar of hot-rolled steel;

peeling said bar;

cutting said bar so as to obtain at least one block;

through drilling said block;

chemically treating said drilled block, the step of chemically treating said drilled block comprising: immersing said block in a phosphatizing solution based on zinc phosphate diacid, nitric acid, zinc nitrate and phosphoric acid, diluted in water at 5 to 20% at a temperature of 60 to 85° C. for a time between 5 and 15 minutes in order to produce a zinc phosphate coating on said block which is compact and uniform and has a very fine crystalline structure to facilitate the mechanical deformation of the material of said block while cold; rinsing said block in hot water at a temperature of 60 to 85° C. for a time which can vary between 5 and 15 minutes: immersing said block in a passivating neutralizing alkaline-reacting solution based on sodium borates, sodium carbonate and sodium sulfite, diluted in water so as to provide a pH between 7 and 9.5, for a time between 5 and 15 minutes; immersing said block in a lubricating soap solution based on sodium stearates such that the lubricant of said lubricating solution, by reacting with the zinc phosphate coating, forms zinc soaps which further improve an antifriction barrier of the coating and also provide excellent lubrication, and such that a percentage of dilution of said soap in water varies between 3 and 12%, at a temperature of 60 to 80° C., for a time between 2 and 10 minutes;

pressing said block; and obtaining a product which after the step of pressing said block is internally and externally finished with a size tolerance for an outside diameter of said product within 0.20 mm, a size tolerance for an outside diameter of said product within 0.12 mm, a maximum roughness of external and internal surfaces (Ra) or said product equal to 3.5, and a maximum value of a concentricity between the inside and outside diameters of said product equal to 0.20 mm.

2. The method according to claim 1, applied to products made of steel of the types from AISI/SAE 1010 to AISI/SAE 4150 and special casehardening and hardening and tempering steels from C10 to 50CrMo4, wherein wherein the step of peeling said bar comprises removing a layer of material having altered metallurgical characteristics which is present externally on said bar.

3. The method according to claim 1, wherein the step of through drilling said block forms a bore in said block having a diameter comprised between 10 to 50 mm.

4. The method according to claim 1, wherein the step of chemically treating said drilled block comprises immersing said drilled block in an alkaline degreasing solution based on sodium hydroxide and metallic sodium silicates, in a percentage between 2 and 15% in water, at a temperature of 70 to 95° C., for a time between 5 and 15 minutes.

5. The method according to claim 1, wherein the stop of through drilling said block forms a bore in said block, and wherein the step of pressing said block comprises inserting said block in a die made of special steel for hot metalworking and passing a plunger, constituted by a cone having an angle of aperture between 10 and 50°, in an advancement direction in the bore of said block to apply compression such that the material of the block deforms in an opposite direction with respect to the advancement direction of the plunger.

6. The method according to claim 1, further comprising a step of final turning and heat treatment of said block so as to obtain a finished product.

7. The method according to claim 4, wherein the step of chemically treating said drilled block comprises rinsing the block in hot water at the temperature of 60 to 85° C. for a time between 5 and 15 minutes.

8. A metalworking method for manufacturing a length of tube made of steel comprising the steps of:

producing a round bar of hot-rolled steel having a carbon content between 0.10% and 0.50%;

peeling said bar;

cutting said bar so as to obtain at least one block;

drilling said block to form a cylindrical bore in said block which extends along an extension of said block entirely through said block between opposite ends of said block;

chemically treating an external surface of said drilled block;

pressing said drilled block with a backward drawing process by inserting said drilled block in a die and passing a plunger having the form of a cone with an angle of aperture between 10 and 50° through said bore in said drilled block in an advancement direction of said plunger entirely through said bore between said opposite ends of said drilled block to deform the material of said drilled block in an opposite direction with respect to the advancement direction of the plunger so as to obtain a pressed-deformed drilled block having a cylindrical bore in said pressed-deformed drilled block which extends along an extension of said pressed-deformed drilled block entirely through said pressed-deformed drilled block between opposite ends of said pressed-deformed drilled block and which has a diameter which is larger than said bore of said drilled block before the step of pressing.

* * * * *